US005095335A

United States Patent [19]

Watanabe et al.

[11] Patent Number: 5,095,335

[45] Date of Patent: Mar. 10, 1992

[54] COPIER WITH RETRACTABLE CHARGING UNIT TO PREVENT DAMAGE TO DRUM WHEN REMOVING PROCESS CARTRIDGE

[75] Inventors: Kazushi Watanabe; Takashi Hibi, both of Yokohama; Norihisa Hoshika, Kawasaki; Masahide Kinoshita; Takeo Shoji, both of Yokohama, all of Japan

[73] Assignee: Canon Kabushiki Kaisha, Tokyo, Japan

[21] Appl. No.: 584,918

[22] Filed: Sep. 18, 1990

[30] Foreign Application Priority Data

Sep. 19, 1989 [JP] Japan ..... 1-240728
Oct. 12, 1989 [JP] Japan ..... 1-265787

[51] Int. Cl.[5] ..... G03G 15/00
[52] U.S. Cl. ..... 355/210; 355/219
[58] Field of Search ..... 355/200, 210, 211, 219, 355/221, 222, 245, 260

[56] References Cited

U.S. PATENT DOCUMENTS 4,851,960 7/1989 Nakamura et al. ..... 361/225
4,896,193 1/1990 Kagiura et al. ..... 355/245 X

FOREIGN PATENT DOCUMENTS 58-82285 5/1983 Japan .
0140759 8/1983 Japan ..... 355/219
0292166 11/1988 Japan ..... 355/219

*Primary Examiner*—A. T. Grimley
*Assistant Examiner*—Christopher Horgan
*Attorney, Agent, or Firm*—Fitzpatrick, Cella, Harper & Scinto

[57] ABSTRACT

An image forming apparatus includes a cartridge detachably mountable to the image forming apparatus, the cartridge including a movable image bearing member; a charging member having a contact member for contacting to the image bearing member in the cartridge to charge the image bearing member, the contact member is mounted in the image bearing member; a supporting member for supporting the contact member for movement between a first position where the contact member is contacted to the image bearing member and a second position where the contact member is away from the image bearing member; a member actable on the supporting member in accordance with mounting or dismounting of the cartridge relative to the image forming apparatus; wherein upon dismounting of the cartridge, the contact member is moved from the first position to the second position.

11 Claims, 9 Drawing Sheets

COPIER WITH RETRACTABLE CHARGING UNIT TO PREVENT DAMAGE TO DRUM WHEN REMOVING PROCESS CARTRIDGE

FIELD OF THE INVENTION AND RELATED ART

The present invention relates to an image forming apparatus such as an electrophotographic copying machine, a laser beam printer, an LED printer, liquid crystal shutter printer or electrostatic recording machine, more particularly to an image forming apparatus having charging means contactable to an image bearing member such as a photosensitive member or a dielectric member to charge the image bearing member.

In such an image forming apparatus, widely used charging means for charging the image bearing member such as a photosensitive member is a corona discharger using a wire electrode. The corona discharger is very effective as the charging means, but involves the drawbacks that a high voltage source (DC 5–8 KV) is required, that a relatively large amount of ozone is produced at the corona discharging, and that the electric power consumption efficiency is not good.

In place of the conventional corona discharger, a contact type charging means contactable to a member to be charged and supplied with a voltage has become noted. The contact type charging means is advantageous in that the voltage applied to the member to be charged in order to provide a desired charge potential can be decreased, in that the amount of ozone produced is very small so that the air discharging system of the machine can be simplified, and also in that the structure is simple. Various proposals have been made as regards the contact charging.

U.S. Pat. No. 4,851,960 having been assigned to the assignee of this application has proposed a contact type charging member supplied with a DC biased vibratory voltage (the voltage periodically changes with time) which is not less than twice the charge starting voltage relative to the member to be charged in order to uniformly charge the member.

On the other hand, some image forming machines are used with a detachably mountable process cartridge. The process cartridge contains as a unit at least an image bearing member such as a photosensitive drum, charging means for charging the image bearing member, developing means, cleaning means for cleaning the image bearing member within a housing.

Usually, the process cartridge is used up when a predetermined number (for example, 3000–5000) of image forming operations are carried out with it, the service life thereof is deemed to have been used, and a new process cartridge is set. By doing so, the maintenance operation of the image forming apparatus can substantially be eliminated; the operativity and the handling of the image forming apparatus is improved; and a multicolor image can be produced if plural process cartridges having different color developer are interchangingly used. Therefore, the process cartridge type image forming apparatus is put into practical apparatus as a small size personal type apparatus.

In the image forming apparatus of a process cartridge type, the charging means for charging the image bearing member in the process cartridge may be in the form of a contact type such as the type described above or a triboelectric contact member type. Then, a simpler image forming apparatus can be provided than when the corona discharger is used.

When the contact type charging means is incorporated in the process cartridge, the contact charging means itself has longer durability than the process cartridge, and therefore, the contact type charging means still having service life has to be exchanged upon the exchange of the process cartridge. In addition, if the process cartridge is kept unused for a long period after manufacturing thereof, the contact type charging means is kept press-contacted to the image bearing member such as the photosensitive member at the same position, a depression can be formed in the contact type charging means or on the image bearing member, with the result of disturbed image formation.

Then, it is considered that the contact type charging means is incorporated in the image forming apparatus rather than the process cartridge, by which the above inconveniences can be eliminated, and the structure of the process cartridge can be simplified with the reduction of the cost. When the contact type charging means is mounted in the image forming apparatus, more particularly, the main assembly thereof, the structure is such that when the process cartridge is mounted on the main assembly, the contact type charging means is press-contacted to the image bearing member in the process cartridge at a predetermined pressure. In this case, it is preferable that the contact charging means does not interfere with any part of the process cartridge (the surface of the image bearing member or the cartridge housing, for example) during the mounting or dismounting operation of the process cartridge relative to the main assembly. Otherwise, a sharp portion of the contact charging means (an edge of a blade type contact charging means) can damage the image bearing member by for example an intended contact or rubbing between the contact type charging means and the image bearing member. On the contrary, the contact type charging means is damaged or deformed or contaminated with foreign matter with the result of trouble of improper charging.

SUMMARY OF THE INVENTION

Accordingly, it is a principal object of the present invention to provide an image forming apparatus of a cartridge type using a contact type charging system, and wherein the image formation is stabilized.

It is another object of the present invention to provide an image forming apparatus wherein the contact type charging means is prevented from contact or rubbing with the image bearing member upon mounting or dismounting operation of the cartridge relative to the image forming apparatus.

It is a further object of the present invention to provide an image forming apparatus usable with a low cost cartridge.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
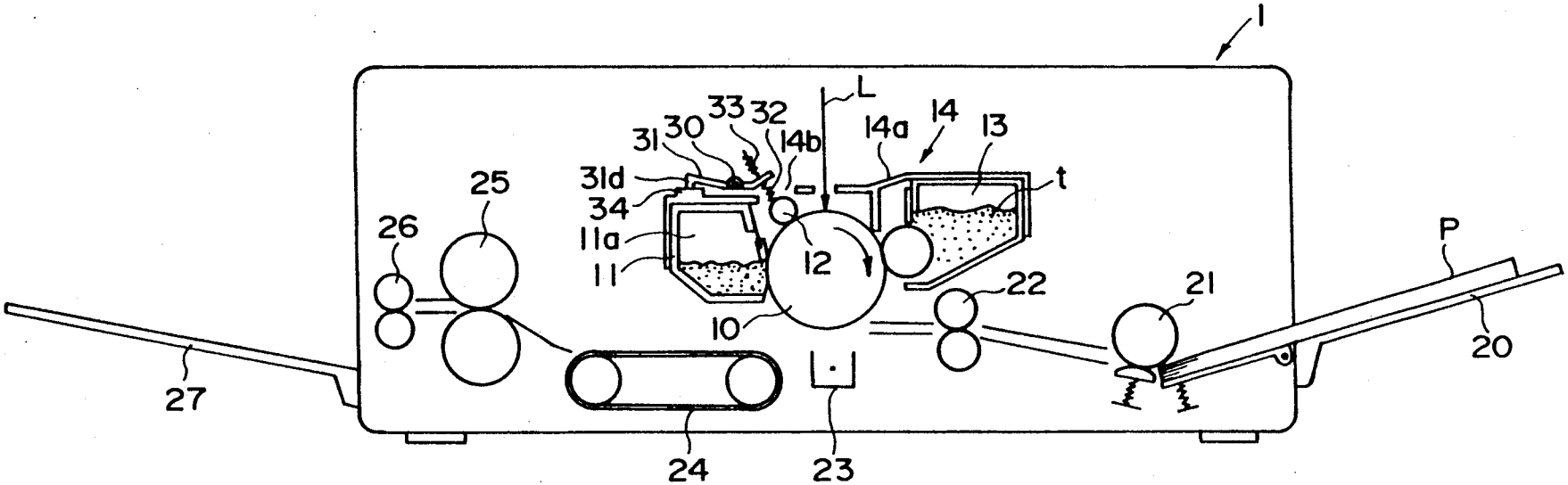
FIG. 1 is a sectional view of an image forming apparatus according to a first embodiment of the present invention.
Figure 2:
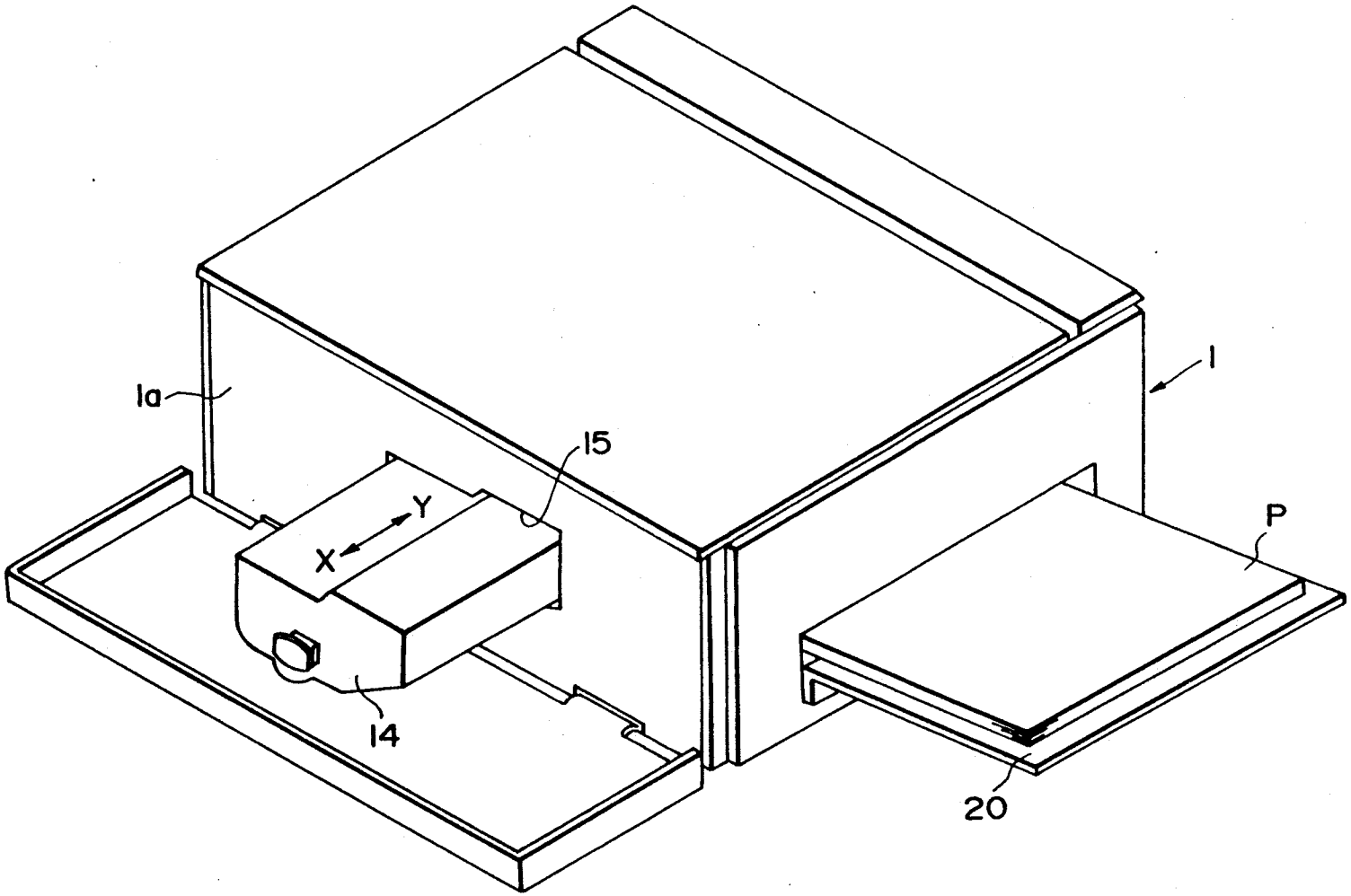
FIG. 2 is a perspective view of the image forming apparatus of the first embodiment which is loaded with the process cartridge.
Figure 3:
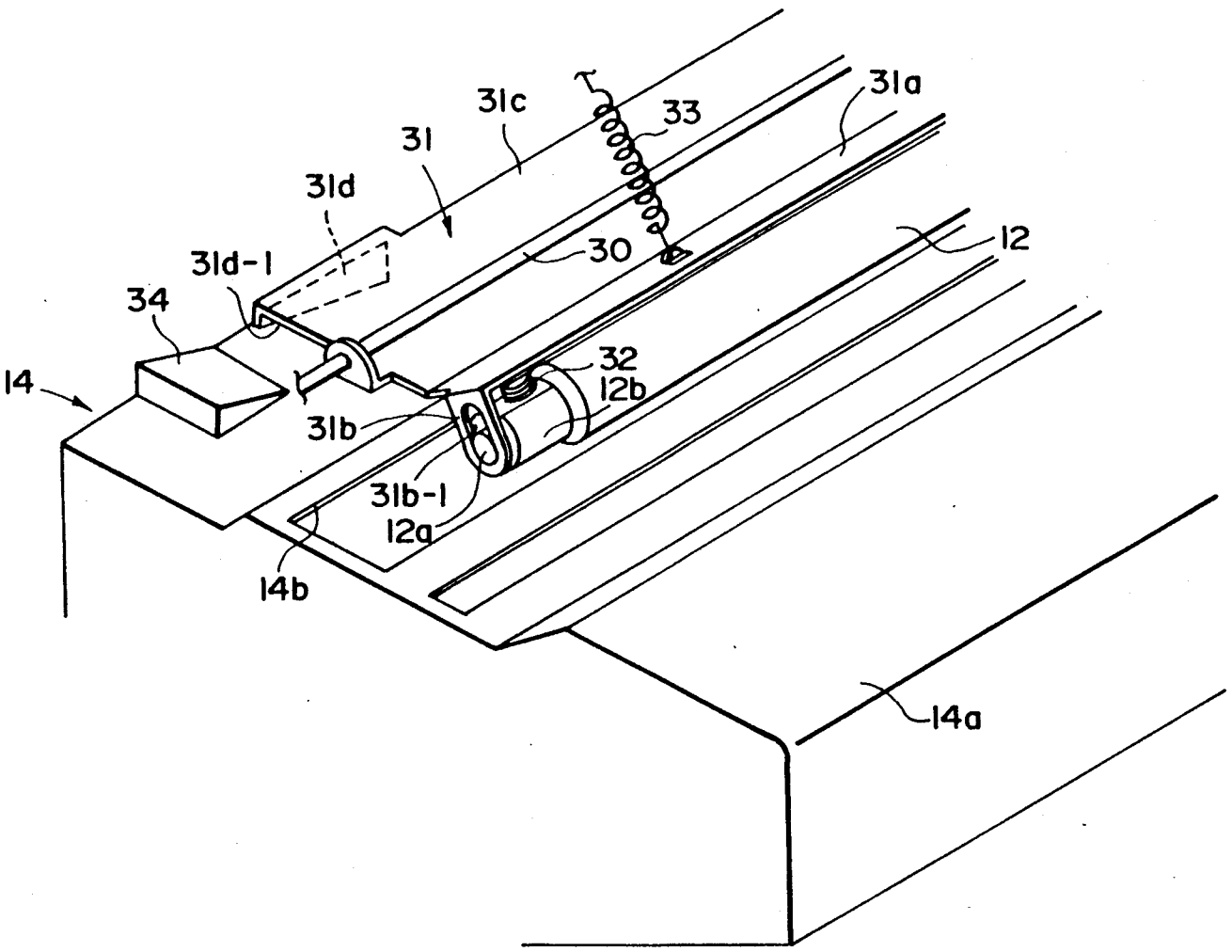
FIG. 3 is a perspective view around a charging roller of the image forming apparatus according to the first embodiment.

Referring to FIGS. 1-3, there is shown a laser beam printer as an exemplary image forming apparatus according to a first embodiment of the present invention.

The description will be first made as to the general arrangement of the image forming apparatus. It comprises an image bearing member in the form of a photosensitive drum 10. Around the photosensitive drum 10, there are disposed a cleaning device 11, a charger 12, a developing device 13 and other process means. Below the means and in the apparatus, there are sheet feed tray 20, sheet feeding roller 21 and registration rollers 22 or the like at the sheet feed side for the transfer sheet P, and there are a conveying belt, a fixing device 25, discharging rollers 26 or the like at the sheet discharge side of the transfer sheet P. Below the photosensitive drum 10, there is a transfer charger 23.

When image light is projected from an unshown laser scanner unit onto the photosensitive drum 10 having been uniformly charged by the charger 12, an electrostatic latent image is formed on the photosensitive drum 10. The electrostatic latent image is conveyed to the developing device 13 by the rotation of the photosensitive drum 10. Then, the electrostatic latent image is visualized into a toner image with toner t in the developing device 13. The toner image is transferred onto the transfer sheet P by a transfer charger 23, and after the image transfer operation, the surface of the photosensitive drum 10 is cleaned by the cleaning device 11, so that the residual toner is removed. Thus, the photosensitive drum 10 is prepared for the next image formation.

On the other hand, the transfer sheet P in the sheet feed tray 20 is picked u one-by-one by the sheet feeding roller 21 and is conveyed to the registration roller 22. The registration roller 22 directs the transfer sheet P to between the photosensitive drum 10 and the transfer charger 23 in timed relation with the toner image on the photosensitive drum 10. The toner image is transferred from the photosensitive drum 10 to the transfer sheet P. The transfer sheet P carrying the toner image is conveyed by the conveying belt 24 to the fixing device 25, where the toner image is fixed into a permanent image. Then, the transfer sheet P is discharged to the tray 27 by the discharging rollers 26.

In this embodiment, the photosensitive drum 10, the cleaning device 11 and the developing device 13 are contained in a cartridge container **14*a* (housing), so that a process cartridge 14 is constituted which is detachably mountable to the main assembly 1 of the apparatus as a unit. The process cartridge 14 as a whole is exchanged when the residual toner container 11*a* in the cleaning device 11 is filled with the residual toner, when the toner t in the developing device 13 is used up or when the service life of the photosensitive drum 10, the developing device 13** or the like is reached. By doing so, the maintenance operation for the image forming apparatus becomes easier.

As shown in FIG. 2, the process cartridge 14 is mounted to or demounted from the main assembly 1 of the apparatus in a horizontal plane in a direction of an axis of the photosensitive drum 10 (X-Y direction in FIG. 2) through a cartridge insertion opening 15 formed in a front side **1*a*** of the main assembly of the apparatus.

The charger 12 includes a roller press-contactable to the photosensitive drum 10, as disclosed in U.S. Pat. No. 4,851,960. A predetermined bias voltage is applied thereto by an unshown bias voltage applying means. The charger 12 is supported on the main assembly 1, and is inserted into the process cartridge through an insertion opening **14*b* of the cartridge container 14*a* of the process cartridge, and it is press-contacted to the photosensitive drum 10. Upon mounting or dismounting of the process cartridge 14 relative to the main assembly of the image forming apparatus, the charger 12 is moved away from the photosensitive drum by releasing of the press-contact to the photosensitive drum 10. By doing so, the sliding contact between the photosensitive drum 10 and the charger 12 is prevented upon the mounting and dismounting of the process cartridge 14** relative to the main assembly.

Referring to FIG. 3, the description will be made as to the structure and operation of the supporting mechanism for the charger 12. Hereinafter, the charger 12 is called "charging roller", too.

As shown in FIG. 3, a supporting shaft 30 is supported on the main assembly 1 in parallel with the axis of the photosensitive drum 10 of the process cartridge on the supporting shaft, a roller supporting plate 31 is rotatably mounted. Below a right end **31*a* of the roller supporting plate 31 in the direction parallel to the supporting shaft 30, a charging roller 12 is rotatably supported. More particularly, at front and rear ends of the right end 31*a* of the roller supporting plate 31, supporting portion 31*b* and 31*b* (only one of them is shown in FIG. 3) project downwardly. In the guiding grooves 31*b*-1, 31*b*-1 formed in the supporting portion 31*b* and 31*b*, end portions of the shafts 12*a* and 12*a* of the charging roller is rotatably supported. Between shaft portions 12*b* and 12*b* having a diameter larger than that of the portions 12*a* and 12*a* of the charging roller 12 and the right end 31*a* of the roller supporting plate 31, springs 32 and 32 are stretched (only one of them is shown in FIG. 3). Thus, the charging roller 12 is urged downwardly in the guide grooves 31*b*-1 and 31*b*-1 of the supporting portions 31*b* and 31*b* of the roller supporting plate 31**.

The left end 31*c* of the roller supporting plate 31 is bent into a bent portion 31*d*. The bottom edge 31*d*-1 of the bent portion 31*d* is inclined downwardly from the front to the rear. The top surface of the right end 31*a* of the roller supporting plate 31 is lifted by a spring 33 suspending from the main assembly 1, so that the roller supporting plate 31 is supported in a substantially horizontal plane including the shaft 30.

When the process cartridge 14 is mounted into the main assembly 1, the process cartridge 14 is inserted horizontally into the space below the roller supporting plate 31 maintained substantially in the horizontal plate. The cartridge container 14 below the charging roller 12 supported at the right end 31*a* of the roller supporting plate 31 is provided with a roller receiving opening 14*b* for receiving the charging roller 12 to the neighborhood of the photosensitive drum 10 of the process cartridge 14. Above the front part of the cartridge container 14*a* in the direction of the mounting or dismounting of the process cartridge, there is an urging portion 34 rising toward the front side for engagement with the bottom edge 31*d*-1 of the bent portion 31*d* formed at the left end 31*c* of the roller supporting plate 31.

When the process cartridge 14 is out of the main assembly, the roller supporting plate 31 is placed substantially horizontally. Therefore, even if the process cartridge 14 is inserted into the main assembly of the apparatus through an insertion opening 15 (FIG. 2) formed in the front side of the main assembly, the charging roller 12 mounted on the roller supporting plate 31 and the roller supporting plate 31 do not obstruct the insertion of the process cartridge 14.

Since the urging portion 34 of the cartridge container 14*a* is engaged to the bottom edge 31*d*-1 of the bent portion 31*d* of the roller supporting plate 31 when the process cartridge 14 is generally completely mounted into the main assembly 1, the roller supporting plate 31 is rotated against the spring force of the spring 33 about the shaft 30 in the clockwise direction in FIG. 3, so that the right end 31*a* is lowered. Therefore, the charging roller 12 is inserted into the cartridge container 14*a* through the roller insertion opening 14*b* of the process cartridge 14, and is press-contacted to the photosensitive drum 10. In this case, even if the charging roller 12 is excessively moved toward the photosensitive drum 10, the charging roller 12 moves upwardly against the springs 32 and 32 along the guide grooves 31*b*-1, 31*b*-1, and therefore, the contact pressure between the charging roller 12 and the photosensitive drum 10 is maintained correctly. Therefore, the photosensitive drum 10 is properly and uniformly charged by the charging roller 12 upon the image forming operation.

When the process cartridge 14 is to be dismounted from the main assembly 1, the process cartridge 14 is first slightly retracted (the sliding between the charging roller 12 and the photosensitive drum 12 by this is not significant and negligible). Then, the engagement between the urging portion 34 of the cartridge container 14*b* and the bent portion 31*d* of the roller supporting plate 31 is released by which the roller supporting plate 31 rotates about the shaft 30 in the counterclockwise direction in FIG. 3 by the elastic force of the spring 33. Then, the charging roller 12 is moved out of the process cartridge 14 through the roller insertion opening 14*b* of the cartridge container 14*a*, and the roller supporting plate 31 is returned to the horizontal position. Therefore, the process cartridge 14 can be easily taken out of the main assembly 1.

As will be understood the foregoing description, the charging roller 12 is mounted on the main assembly, and when the process cartridge 14 is mounted in the main assembly, the charging roller 12 is urged to the photosensitive drum 10 in the process cartridge. Still, when the process cartridge 14 is taken out of the main assembly 1, the urging portion 34 of the process cartridge and the bent portion 31*d* of the roller supporting plate 31 cooperate to move the charging roller 12 away from the photosensitive drum in the process cartridge 14 in association with the dismounting of the process cartridge to the outside of the process cartridge 14. Therefore, the dismounting of the process cartridge 14 from the main assembly 1, the charging roller 12 is not rubbed with the photosensitive drum 10. Upon the mounting of the process cartridge 14 to the main assembly 1, the charging roller 12 is away from the process cartridge 14 and therefore, it does not obstruct the mounting of the process cartridge to the main assembly. Immediately before the completion of the mounting of the process cartridge 14 to the predetermined position in the main assembly 1, the charging roller 12 is inserted into the process cartridge 14 to be press-contacted to the photosensitive drum 10, and therefore, the charging roller 12 and the photosensitive drum 10 are not rubbed with each other.

Furthermore, the charging roller 12 is disposed outside the process cartridge 14, the photosensitive drum 10 or the charging roller 10 do not have any depression caused by continuing urging of the charging roller 12 to the photosensitive drum 10 during a long non-use period.

Figure 4:
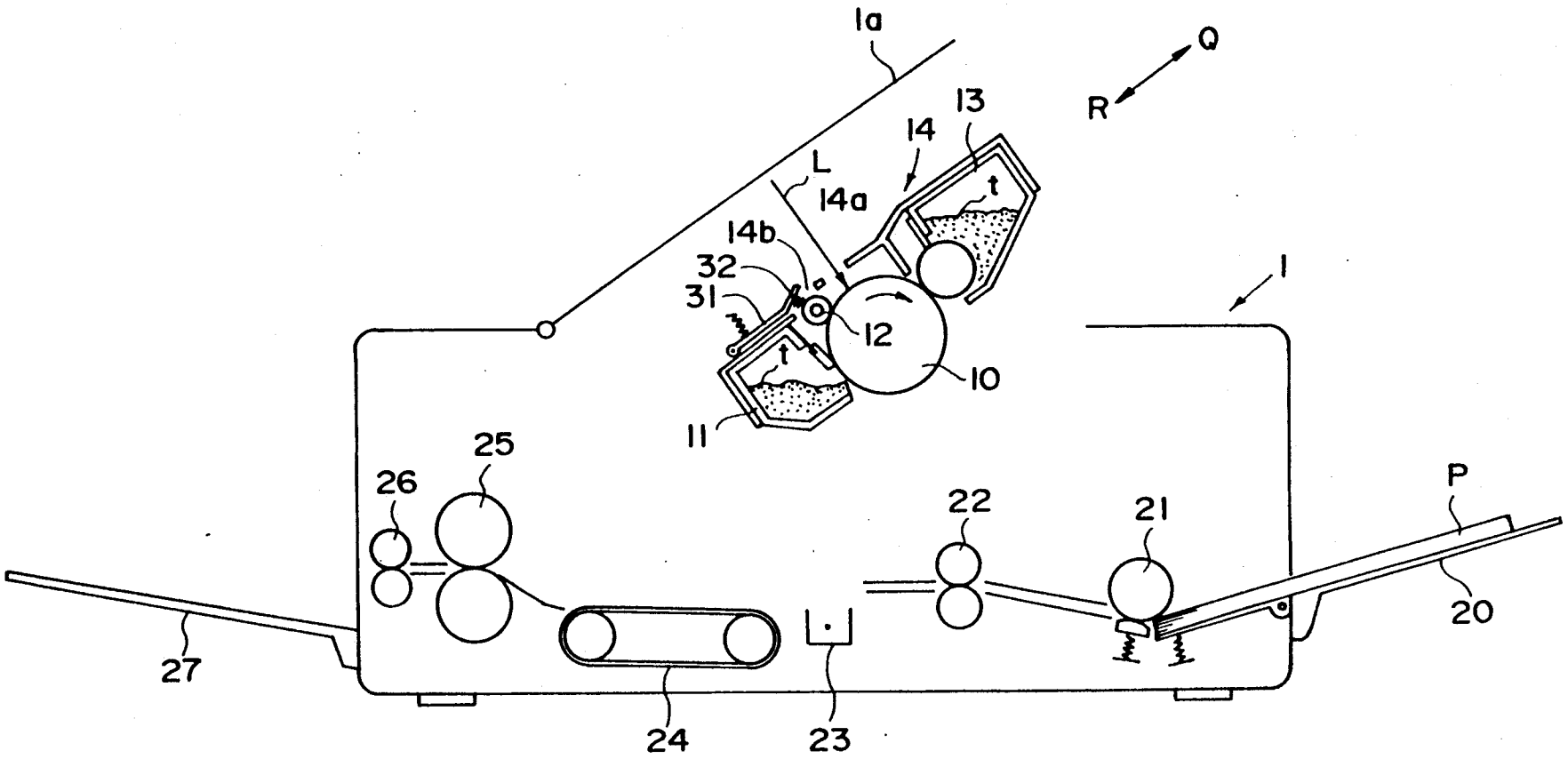
FIG. 4 is a sectional view of the image forming apparatus according to a second embodiment of the present invention.
Figure 5:
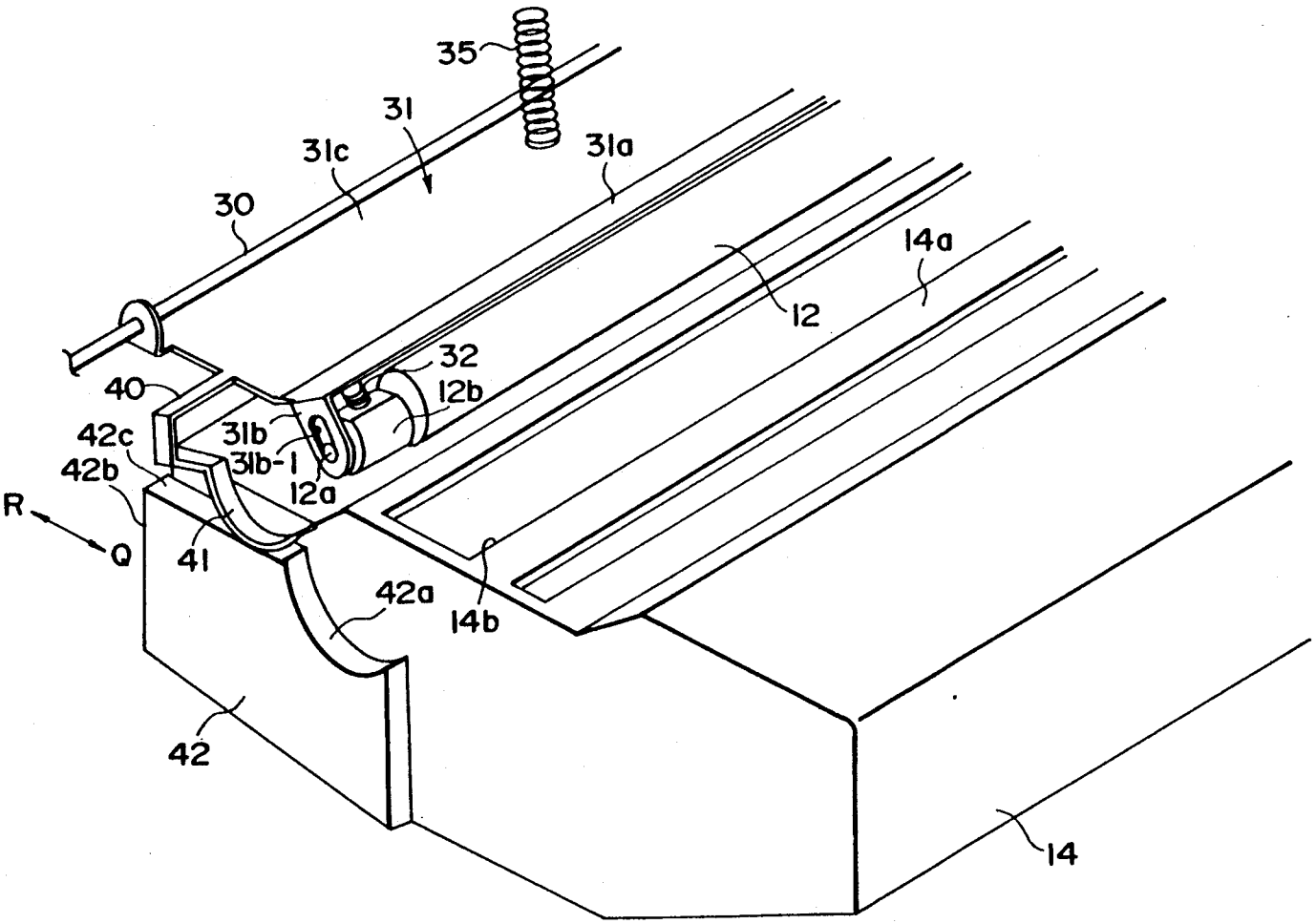
FIG. 5 is a perspective view around the charging roller in the image forming apparatus according to the second embodiment of the present invention.

Referring to FIGS. 4 and 5, the second embodiment of the present invention will be described. The same reference numerals as in the first embodiment are assigned to the elements having the corresponding functions, and the detailed description thereof is omitted for the sake of simplicity.

In the first embodiment, the process cartridge 14 is mounted to or dismounted from the main assembly 1 in the direction of the photosensitive drum 10 axis (X-Y direction) through a front side of the main assembly. However, in this embodiment, the process cartridge 14 is mounted to or dismounted from the main assembly 1 in a direction perpendicular to the axis of the photosensitive drum (R-Q detection in FIG. 4). In this embodiment, too, the charging roller 12 is moved away from the process cartridge 14 upon the mounting or dismounting of the process cartridge 14 relative to the main assembly.

As shown in FIG. 4, the process cartridge 14 is supported on a top cover 1*a* of the main assembly 1. When the process cartridge 14 is mounted to or dismounted from the main assembly 1, the top cover 1 is rotated upwardly about a pivot, as shown in FIG. 4. Thereafter, the process cartridge 14 is moved in the direction R-Q.

As shown in FIG. 5, the roller supporting plate 31 is rotatably supported on the shaft 30 supported on the main assembly 1, at its left end 31*c*. To the right end 31*a* of the roller supporting plate 31, similarly to the first embodiment, the charging roller 12 is supported, wherein the opposite end shaft portions 12*a* and 12*a* are rotatably supported in the guide grooves 31*b*-1 and 31*b*-1 of the supporting portions 31*b* and 31*b*. At the front end of the roller supporting plate 31, a rightward bent engaging portion 41 is projected through a thin connecting portion 41. The engaging portion 41 is arcuated downwardly from the connecting portion 40, and the connecting portion 40 provides spring force to displace the engaging portion 41 substantially vertically. To the roller supporting plate 31, a spring 35 is mounted which is mounted to the main assembly at the other end. The right end 31*a* of the roller supporting plate 31 is lowered sufficiently by the spring 35.

To the front end of the cartridge container 14*a* of the process cartridge 14, a guide plate 42 is mounted. To the guide plate 42, the bottom surface of the engaging portion 41 of the roller supporting plate 31 is in sliding contact. In the upper right portion of the guide plate 42, a cut-away portion 42 is formed which is configured with the engaging portion 41 of the roller supporting plate 31. When the process cartridge 14 is mounted into the main assembly 1, the top cover 1*a* of the main assembly 1 is opened, and the process cartridge 14 is inserted in the direction R in FIG. 5. At this time, the roller supporting plate 31 rotates about a shaft 30, and the charging roller 12 supported at the right end 31*a* is disposed in the path of the process cartridge 14, and therefore, the charging roller 12 seems to obstruct the mounting of the process cartridge 14, on the surface. However, before the left end of the process cartridge 14 is contacted to the charging roller 12, the left end 42*b* of the guide plate 14 urges upwardly against the spring force of the spring 35 the bent engaging portion 41 of the supporting roller 31, and therefore, the roller supporting plate 31 rotates in the clockwise direction in FIG. 5 about the shaft 30 to lift the charging roller 12 upwardly. Therefore, the process cartridge 14 is easily mounted in the main assembly 1. In this case, the engaging portion 41 of the roller supporting plate 31 slides on the top surface 42*c* of the guide plate 42 of the process cartridge 14, and finally it is positioned on the cut-away portion of the guide plate 42. Therefore, the charging roller 12 on the roller supporting plate 31 is inserted into the process cartridge 14 through a roller insertion opening 14*b* of the cartridge container. Then, it is press-contacted to the photosensitive drum 10 by the spring force of the spring 35.

When the process cartridge 14 is taken out of the main assembly 1, the reverse operation is performed. The charging roller 12 can be retracted from the photosensitive member 10 in the process cartridge 14 by the cooperation between the guide plate 42 of the process cartridge 14 and the engaging portion 42 of the roller supporting plate 31, and the process cartridge 14 can be taken out of the main assembly 1 without the friction between the charging roller 12 and the photosensitive drum 10.

The same advantageous effects as in the first embodiments can be provided.

Figure 6:
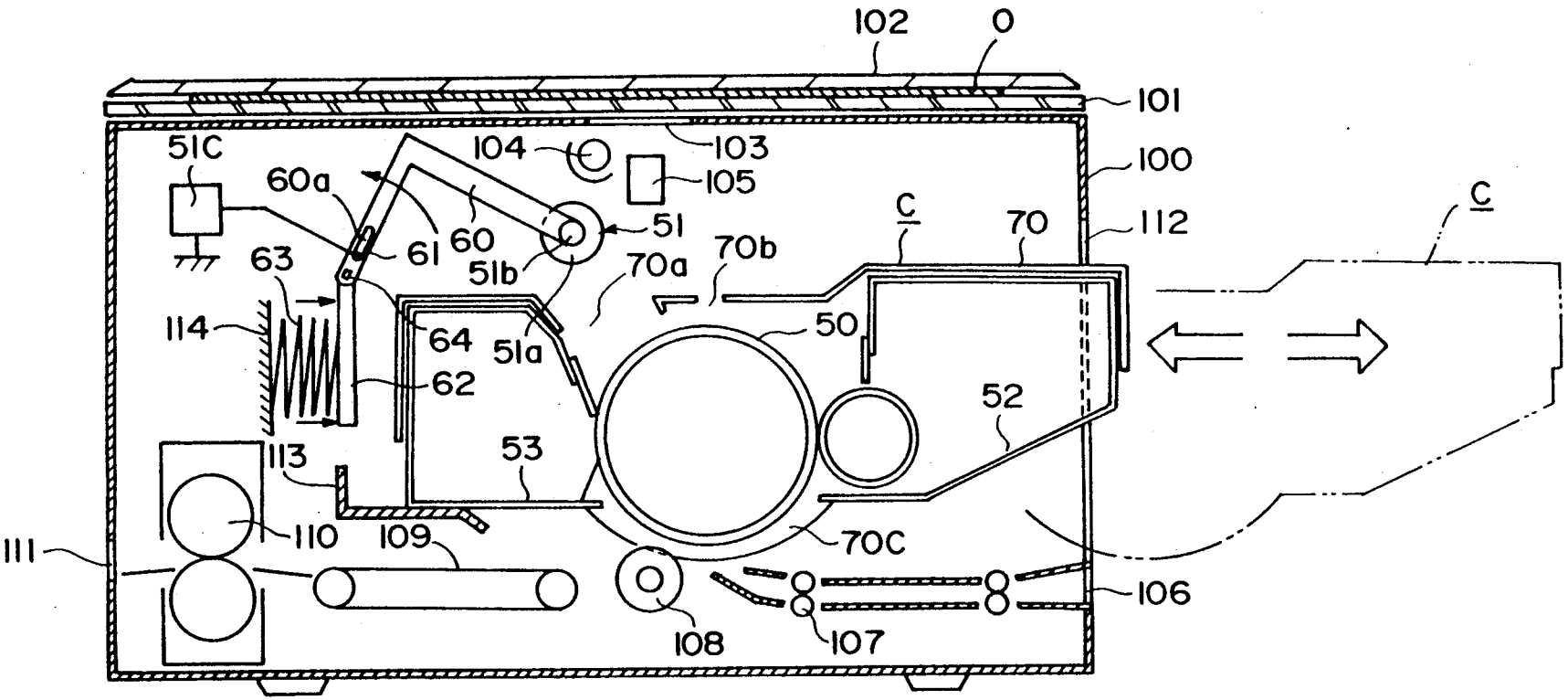
FIG. 6 shows an image forming apparatus according to a third embodiment of the present invention when the process cartridge is being mounted or dismounted.
Figure 7:
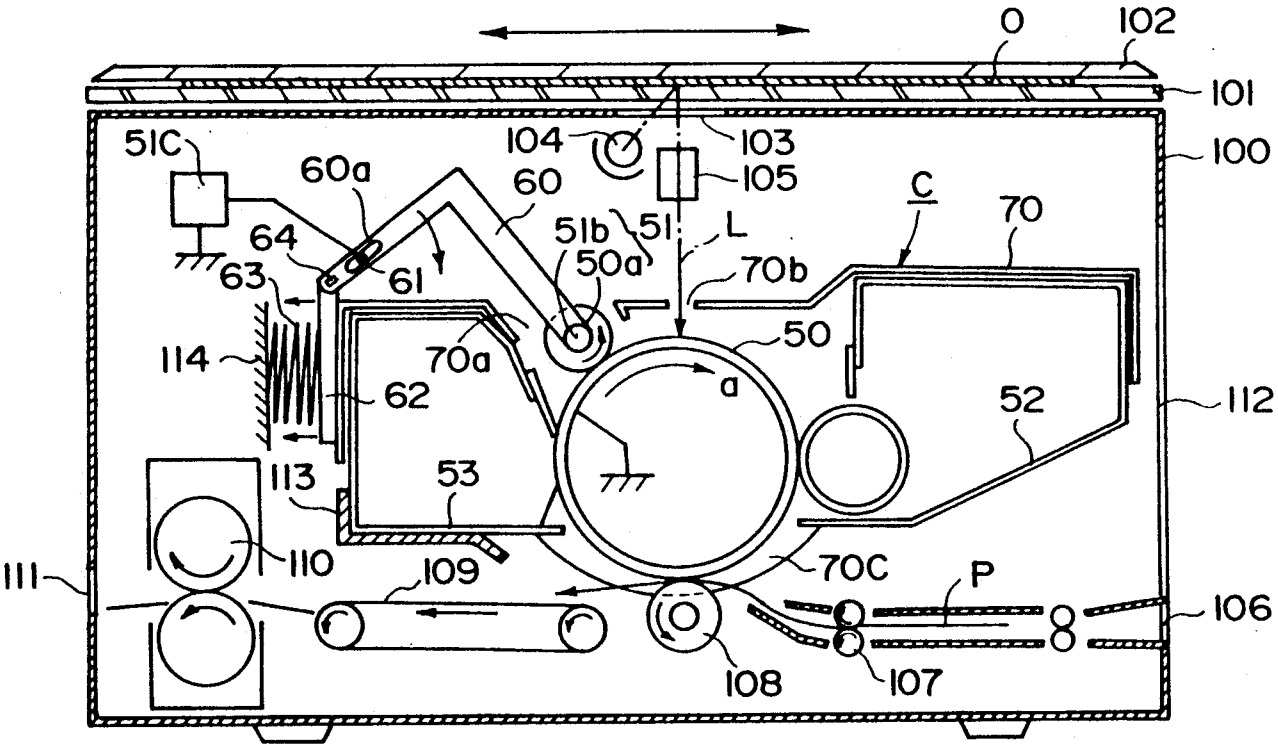
FIG. 7 shows the image forming apparatus according to the third embodiment when the cartridge is mounted, and the copying operation is performed.

Referring to FIGS. 6 and 7, a third embodiment of the present invention will be described.

In this embodiment, the image forming apparatus is an image transfer type electrophotographic copying machine having a movable original carriage. FIG. 6 schematically illustrates the mounting and dismounting of the process cartridge. FIG. 7 schematically shows the image forming apparatus when the copying operation is executed with the process cartridge mounted at the predetermined position.

In FIG. 7, the copying apparatus (the main assembly of the image forming apparatus) has an outer casing 100, a movable original carriage (transparent plate made of glass or resin or the like) on the top surface of the outer casing. The original carriage is reciprocable in the left-right direction in the drawing. An original to be copied is placed face down on the original carriage 101, and an original cover 102 is placed thereon. Upon a start signal, an original carriage 101 starts to move. During the movement stroke, the original carrying surface facing down on the original carriage 101 is illuminated by an illumination lamp 104 through a slit 103 to be scanned from one side to the other side. The light reflected by the original surface is imaged by imaging element 105 on the surface of the photosensitive member 50 in the form of a rotatable drum (image bearing member), as indicated by a reference L. The photosensitive member 50 in response to the copy start signal, is rotated at a predetermined peripheral speed (process speed) in a direction a (clockwise direction). The photosensitive member is charged by the contact charger 51 upstream of the exposure station with respect to the rotational direction of the photosensitive drum.

The contact charging member 51 in this embodiment, has a metal shaft 51*b* and a resin or rubber layer 51*a* having a volume resistivity of approximately $10^9$ ohm.cm, into a form of a roller (charging roller).

The charging roller 51, as will be described hereinafter, is rotatably supported on bearings at a free end side of a swingable lever 60. When the process cartridge C is in place in the main assembly, it is kept contacted to the surface of the photosensitive member 50 of the process cartridge, so that it rotates following rotation of the photosensitive member 50. The charging roller 51 is supplied with a predetermined bias voltage (a DC biased AC voltage, for example) from a bias source 51, so that the peripheral surface of the photosensitive member 50 is charged to a predetermined potential.

When the image light L described above is applied to the surface of the rotating photosensitive member 50 having been subjected to the charging operation by the charger, an electrostatic latent image is formed in accordance with the light image projected onto the surface of the photosensitive member 50.

The formed latent image is developed into a toner image by the developing device 52.

On the other hand, a transfer material P introduced into the apparatus through a transfer material inlet 106 is supplied to the transfer station, that is, between the photosensitive drum 50 and the transfer roller 108, at a proper timing by the registration rollers 107. The toner image is transferred sequentially from the photosensitive member 50 to the transfer material P.

The transfer material P having received the toner image is separated from the surface of the photosensitive drum 50, and is conveyed by the conveyer belt 109 to a fixing device 110 where it is subjected to the image forming operation. Finally, it is discharged to the outside of the apparatus through the discharging opening 111, as a print (copy). After the image transfer operation, the surface of the photosensitive member 1 is cleaned by the cleaning device 53 by which the residual toner or other contaminations are removed from the photosensitive member, so that the photosensitive member is prepared for the next image forming operation.

The process cartridge C contains a photosensitive member 50, a developing device 52 and the cleaning device 53 (three process means), they are mounted in the common housing 70 with predetermined positional relations among them.

A cartridge insertion opening 112 is formed at right side of the main assembly in the Figure. The process cartridge C is mounted into the apparatus by inserting it through the opening 112 with the cleaning device 53 side leading along an unshown guide of the main assembly toward left until the leading edge of the cartridge abuts a receiving member 113 of the main assembly and is stopped (From FIG. 6 to FIG. 7). The cartridge C when set in place in the main assembly, it is mechanically and electrically coupled with the main assembly, so that the drive transmission, electric power supply and the transfer of electric signals are enabled.

The cartridge C is taken out of the main assembly by retracting the cartridge toward right.

A swingable lever 60 rotatable supporting the charging roller 60 has generally L-shaped configuration. At an end of one of the arms thereof, the charging roller 51 is rotatably supported. At a side adjacent the end of the other arm, an opening 60*a* elongated along the length of the arm is formed. The elongated opening 60*a* is engaged with a pin 61 of a fixed member on the main assembly. The lever 60 swings about the pin 61.

Reference numeral 62 is a sliding plate slidable in the direction of the mounting and dismounting direction of the cartridge (left-right direction) above the cartridge receiving member 113. Reference numeral 63 designates a spring stretched between a back side of the sliding plate and a fixed member 114 on the main assembly. The top side of the sliding plate 62 and an end of the other arm of the swinging lever 60 are rotatably connected by a shaft 64.

The leading edge of the process cartridge C moves toward and away from the sliding plate 62. When the leading end surface of the cartridge C is out of contact with the sliding plate 62 (free), the urging force of the spring 63 moves the sliding plate 64 rightwardly, and is at the advanced position where the surface thereof is slightly inner beyond the cartridge receiving position of the cartridge receiving member 113. In association with the advancement of the sliding plate 62, the swingable lever 60 is rotated in the counterclockwise direction, by which the charging roller 51, as shown in FIG. 6, is lifted to the release position outside the cartridge moving path of the main assembly, and is stably retained at this position.

When the cartridge C is inserted into the main assembly, and immediately before the leading edge of the cartridge C abuts the receiving member 113, the leading edge of the cartridge C is contacted to the surface of the sliding plate 62. By the continuous cartridge pushing movement, the sliding plate 62 is retracted leftwardly against the spring 63.

Therefore, before the cartridge C is inserted into the main assembly to a substantial extent and before the leading end of the cartridge is contacted to the sliding plate 62, the charging roller 51 is maintained away from the cartridge mounting path, as shown in FIG. 6, and therefore, the contact or interference between the charging roller 51 and the process cartridge C is avoided.

In association with the leftward retraction of the sliding plate 62 against the spring 63 together with the further pushing of the cartridge, the swingable lever 60 rotates clockwisely, by which the charging roller 51 is lifted into the first opening 70*a* in the top surface of the cartridge C. At the point of time when the cartridge C is finally received by the receiving member 113 so that the mounting is completed, the charging roller 51 is press-contacted to the photosensitive member 50 in the cartridge C, as shown in FIG. 7, and this state is maintained.

Upon the completion of the mounting of the cartridge C, a second opening 70*b* for permitting exposure of the photosensitive drum is disposed right below the imaging element 105. In addition, in a third opening 70*c* in the bottom surface of the cartridge, the transfer roller 105 is press-contacted to the surface of the photosensitive drum 50. When the cartridge C is taken out, at the initial stage of the retracting movement of the cartridge until the leading end surface of the cartridge is moved away from the surface of the sliding plate 62, the swingable lever 60 is rotated in the clockwise direction in association with the advancement of the sliding plate 62 by the spring 63 together with the retraction of the cartridge, so that the charging roller 51 is lifted to be away from the surface of the photosensitive member 50 in the cartridge C, and is retracted through the first opening 70 of the cartridge C. It is then, retained at a retracted position out of the path of the cartridge. Therefore, in the subsequent cartridge retracting process, the contact and the interference between the charging roller 51 and the cartridge C is avoided, so that the charging roller 51 is protected.

In this embodiment, the bias voltage application to the charging roller 51 is effected by making the swingable arm 60, the central pin 61 thereof with electrically conductive material, wherein the voltage from the voltage source 51*c* is applied by way of pin 61—swingable arm 60—metal shaft 51*b* of the charging roller.

Figure 8:
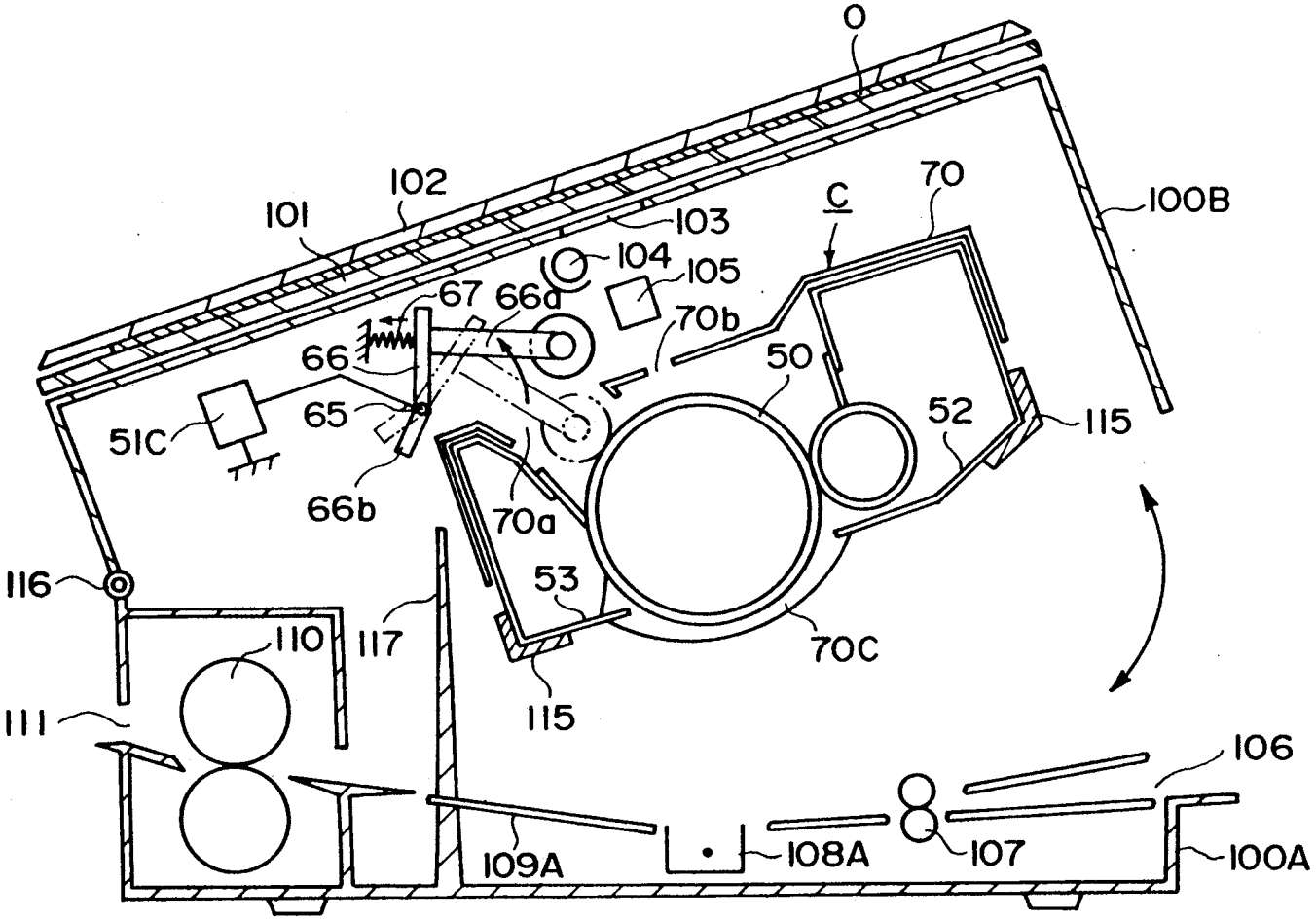
FIG. 8 shows an image forming apparatus according to a fourth embodiment of the present invention, wherein the top frame of the apparatus is opened upwardly.
Figure 9:
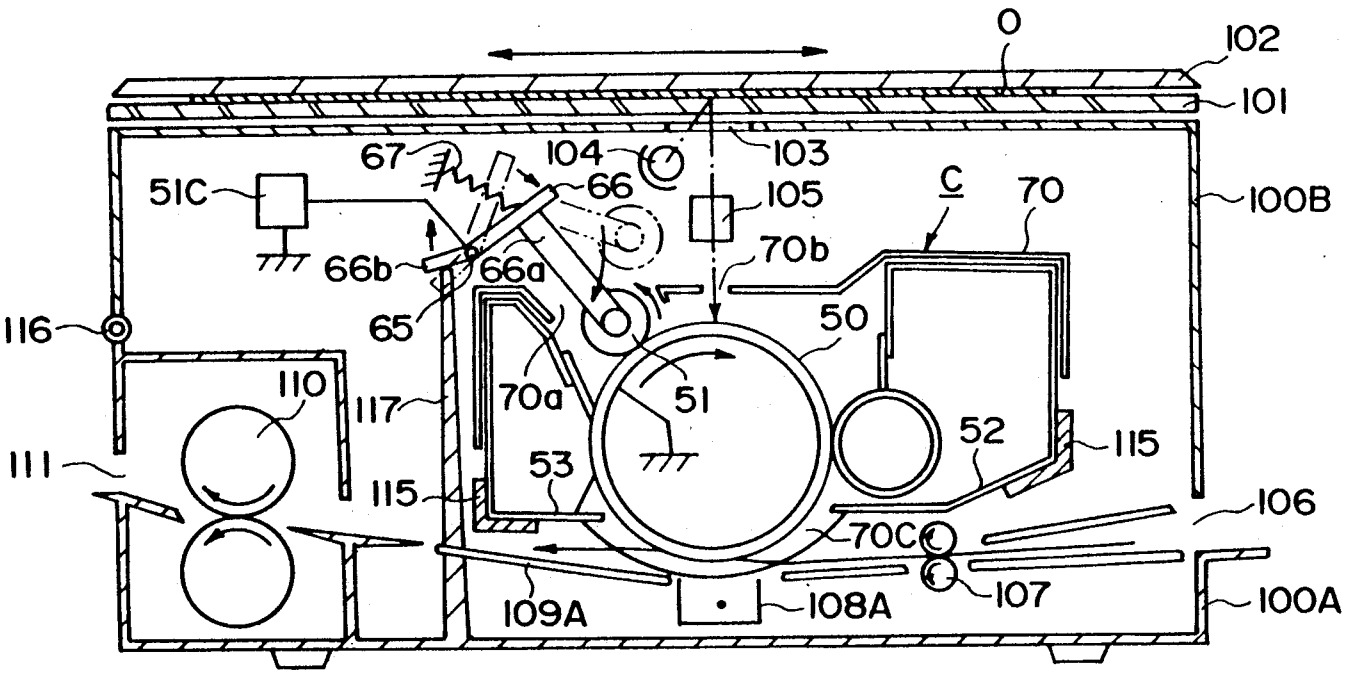
FIG. 9 shows an image forming apparatus according to the fourth embodiment of the present invention when the cartridge is mounted, and the copying operation is carried out.

Referring to FIGS. 8 and 9, a fourth embodiment of the present invention will be described.

In this embodiment, a copying machine comprises a lower frame 100A and an upper frame 100B which is rotatable openable from the lower frame 100A about a hinge 116. In the lower frame 100A, a couple of registration rollers 107, a transfer charger 108A, a transfer material guide 109A, an image fixing device 110 or the like are mounted. In the upper frame 100B, a movable original carriage 101, an illumination lamp 104, an imaging element 105, a charging roller 51, a process cartridge guiding rail 115 or the like are mounted.

The mounting of the process cartridge to the main assembly is effected after a front door (not shown) of the main assembly is opened. The lock of the upper frame 100B is released to open the upper frame 100B about the hinge 116 from the lower frame 100A, as shown in FIG. 8. The process cartridge C is engaged to the guiding rails 115 and 115 in the upper frame 100*b* with the rear side thereof leading, so that it is sufficiently pushed into the upper frame 100B in the direction perpendicular to the sheet of the drawing. Then, the top frame 100B is closed to the bottom frame 100A, and it is locked. Then, the front door is closed.

In the dismounting of the process cartridge C, the operation is reverse.

A charging roller 51 in the form of a contactable charging member actable on the photosensitive member 50 is rotatably supported at an end of a supporting arm 66 fixed on one of the arms of a swingable lever 66. The swingable lever is rotatable about a fixed pin 65 on the top frame 100B. The swingable lever 66 is urged in the clockwise direction normally about the pin 65 by a tension spring 67. By the rotational urging of the lever 66 in the counterclockwise direction, the charging roller 51, when the top frame 100B is opened from the bottom frame 100A is lifted to and retained at a position outside the movement path of the process cartridge C, as shown in FIG. 8 by solid lines, irrespective of whether the process cartridge C is mounted or not mounted.

Therefore, the mounting and dismounting movement of the process- cartridge C relative to the opened top frame 100B is such that contact and interference between the charging roller 51 and the cartridge C is prevented, so that the charging roller 51 is protected.

When the cartridge C is inserted into the opened top frame 100B in the manner described above, and then, the top frame 100B is closed to the bottom frame 100A. Then, during the closing step, the bottom surface of the other arm 66 of the swingable lever 66 abuts the top end of the receiving member 117 at a fixed position of the bottom frame 100A, and therefore the bottom surface is received thereby. By the continuing closing movement of the top frame 100B, the swingable lever 66 is rotated about the pin 65 against the spring force of the tension spring 67, by which the charging roller 51 is lowered into a first opening 70*a* in the top surface of the cartridge C. When the top frame 100B is closed to bottom frame 100A, and the locking is effected, the charging roller 51 is contacted to the surface of the photosensitive member 50 in the cartridge C in a predetermined manner, as shown in FIG. 9 by solid lines, and this state is maintained.

When the top frame 100B is opened, on the contrary, the swingable lever 66 is released from the receiving member 117 as shown in FIG. 8, the lever 66 is rotated in the counterclockwise direction by the tension spring 67, and therefore, the charging roller 51 i retracted to the retracted position.

It is also effective that the contact type charging member is retracted by the releasing action from the operational position of the cartridge as in this embodiment.

In the third and fourth embodiment, in the first, second and third openings 70*a*, 70*b* and 70*c* of the process cartridge, when the process cartridge is out of the apparatus, the openings are closed to protect the surface of the photosensitive member 50 and the inside of the cartridge by an openable shutter member or members. The shutter member is automatically opened in association with the cartridge C mounting action, and is automatically closed in association with the cartridge retracting action. Otherwise, the cover may be manually operable.

The process cartridge C in this embodiment contains three process means, i.e., the photosensitive member, the developing device and the cleaning device. But it will suffice if an image bearing member is contained. For example, the cartridge may contain the photosensitive member and the cleaning device, or may contain the image bearing member and the developing device, as desired.

The mounting and dismounting fashion of the process cartridge C is not limited to the above-described.

The contact type charging member is not limited to the roller type described in the foregoing but it may be in the form of a blade, rod, block, pad, brush, web, belt or the like. It may be a contact member for effecting triboelectric charging.

The image bearing member is not limited to the form of the drum, but it may be in the form of a belt. As described in the foregoing, according to the present invention, the contact between the image bearing member and a contacting type charging member mounted in the main assembly of the image forming member is released in association with retraction of the cartridge containing the image bearing member from the main assembly of the image forming apparatus, so that the contact type charging member is away from the image bearing member. Therefore, the contactable charging member is prevented from being in sliding contact with the image bearing member, and therefore, they are protected from the damage. Also, the trouble such as improper charging attributable to the contact or interference between the contacting member and the cartridge during the mounting and dismounting of the cartridge, can be prevented, and therefore, the good images can be produced for a long period. In addition, the operativity in the cartridge mounting and dismounting operation is good, and a small size reliable image forming apparatus can be provided.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a cartridge detachably mountable to said image forming apparatus, said cartridge including a movable image bearing member;

charging means having a contact member for contacting to the image bearing member in said cartridge to charge the image bearing member, said contact member is mounted separate from said cartridge in said image forming apparatus;

supporting means for supporting the contact member for movement between a first position where the contact member is contacted to the image bearing member and a second position where the contact member is away from the image bearing member;

means actable on said supporting means in accordance with mounting or dismounting of said cartridge relative to said image forming apparatus;

wherein upon dismounting of said cartridge, the contact member is moved from said first position to said second position.

2. An apparatus according to claim 1, wherein said cartridge includes a housing for supporting the image bearing member, and an opening is formed in the housing for permitting insertion of the contact member.

3. An apparatus according to claim 1, wherein the contact member is moved from said second position to said first position when said cartridge is mounted to a predetermined position in said image forming apparatus.

4. An apparatus according to claim 1, wherein the contact member is in the form of a rotatable member which is supplied with a predetermined voltage.

5. An apparatus according to claim 1, wherein said actable means acts when said cartridge is mounted to or unmounted from a predetermined position for permitting an image forming operation of said image forming apparatus.

6. An apparatus according to claim 1, wherein the contact member is urged toward the image bearing member.

7. An apparatus according to claim 1, wherein said cartridge includes a developing means and cleaning means actable on the image bearing member.

8. An apparatus according to claim 1, wherein the contact member moves from said second position to said first position or from said first position to said second position in association with mounting or dismounting of said cartridge relative to said image forming apparatus.

9. An apparatus according to claim 1, 2 or 3, wherein the contact member is away from said cartridge at the second position thereof.

10. An apparatus accordion to claim 1, wherein said cartridge is moved upon the mounting and dismounting in a direction of an axis of the image bearing member.

11. An apparatus according to claim 1, wherein said cartridge is moved in a direction crossing with a direction of an axis of the image bearing member upon mounting and dismounting thereof relative to said image forming apparatus.

* * * * *

UNITED STATES PATENT AND TRADEMARK OFFICE

CERTIFICATE OF CORRECTION

PATENT NO. : 5,095,335

DATED : March 10, 1992

INVENTOR(S) : Watanabe et al.

It is certified that error appears in the above-identified patent and that said Letters Patent is hereby corrected as shown below:

COLUMN 1:

Line 49, "means," should read --means, and--.

COLUMN 3:

Line 61, "picked u" should read --pick up--.

COLUMN 5:

Line 56, "drum 12" should read --drum 10--.

COLUMN 6:

Line 1, "understood" should read --understood from--.

COLUMN 11:

Line 2, "process-" should read --process--.
Line 56, "foregoing" should read --foregoing,--.

Signed and Sealed this

Thirty-first Day of August, 1993

Bruce Lehman

*Attest:*

BRUCE LEHMAN

*Attesting Officer*

*Commissioner of Patents and Trademarks*